United States Patent [19]

Sone et al.

[11] 4,307,431

[45] Dec. 22, 1981

[54] HIGH-VOLTAGE POWER SOURCE

[75] Inventors: Yoshiaki Sone, Tokyo; Kanou Tanaka, Yokohama, both of Japan

[73] Assignee: Canon Kabushiki Kaisha, Tokyo, Japan

[21] Appl. No.: 58,673

[22] Filed: Jul. 18, 1979

[30] Foreign Application Priority Data

Jul., 1978 [JP] Japan ..... 53-92235

[51] Int. Cl.[3] ..... H01T 19/04

[52] U.S. Cl. ..... 361/214; 361/220; 174/35 C; 339/64 M; 355/3 CH

[58] Field of Search ..... 361/214, 235, 229, 220; 355/3 CH; 339/14 P, 64 M, 49 B; 174/35 C; 313/318, 219

[56] References Cited

U.S. PATENT DOCUMENTS

| | | | |
|---|---|---|---|
| 4,196,465 | 4/1980 | Bushor | 361/235 |
| 4,200,909 | 4/1980 | Milum | 361/235 |
| 4,203,144 | 5/1980 | Okamoto | 361/230 |

OTHER PUBLICATIONS

Adley, J.M. et al., "Corona Shell and Emission Wire Assemibly," *IBM Technical Disclosure Bulletin,* vol. 21, No. 3, Aug. 1978.

*Primary Examiner*—J. D. Miller
*Assistant Examiner*—L. C. Schroeder
*Attorney, Agent, or Firm*—Fitzpatrick, Cella, Harper & Scinto

[57] ABSTRACT

A high-voltage power source for suppling a high voltage to corona dischargers used with an electrophotographic apparatus, wherein plural connectors to be connected to the plugs of said corona dischargers are integrally mounted on a casing of a transformer and are connected to the output terminals of said transformer without high-voltage cable thereby eliminating the noise conventionally generated by such high-voltage cable and simultaneously achieving economization of the space and cost required for said cable and the conventionally used separate connectors.

24 Claims, 3 Drawing Figures

HIGH-VOLTAGE POWER SOURCE

BACKGROUND OF THE INVENTION

1. Field of the Invention

The present invention relates to an electrophotographic apparatus, and more particularly to a high-voltage power source for supplying a high voltage to corona dischargers employed in the electrostatic latent image forming step, and the image transfer step etc., in a copier or in an electrostatic recording apparatus.

2. Description of the Prior Art

In an electrophotographic apparatus for obtaining a reproduced image by optical scanning of an original such as a copier, there are employed corona dischargers for various purposes such as a primary charger employed in the formation of the electrostatic latent image on a photosensitive member, a transfer charger for transferring the obtained image onto a transfer sheet, a liquid squeezing discharger in the liquid development process, and a charge eliminator for dissipating the potential on the photosensitive member.

FIG. 1 shows, in a schematic perspective view, the arrangement of a conventionally known photosensitive drum, corona dischargers and a high-voltage power source in such an electrophotographic copier, wherein said components are supported by unrepresented side plates of the copier.

In FIG. 1, around a photosensitive drum 1 there are provided dischargers 2*a*, 2*b* and 2*c* which are respectively connected to connectors 3*a*, 3*b* and 3*c* and further connected through high-voltage cables 4*a*, 4*b* and 4*c* to a high-voltage power source 5, which in turn receives a power supply through input lines 6 and is grounded to the body of the copier through a grounding terminal 7. The photosensitive drum and the casings of the dischargers are similarly grounded to the body of the copier.

Such conventional arrangement is known to have various drawbacks as explained in the following.

Firstly, such conventional arrangement is apt to generate noise. It is to be noted that electronic control utilizing integrated circuits or large-scale integrated circuits are widely used in recent years in copiers and similar apparatus, and for this reason it has become extremely important for avoiding erroneous functions of the control mechanisms to minimize the noise generation inside the apparatus.

However, the conventional high-voltage cables as shown in FIG. 1 tend to become the source of noise, functioning as an aerial. Although the use of shielded cables will prevent such noise generation, such shielded cables are not only expensive themselves but also require additional costs for the cable holders they require and for the high-voltage connector required for each of the corona dischargers. Also the use of such cables results in a considerable useless leak current resulting from the electrostatic capacitance between the cables and ground.

In addition, in an apparatus as shown in FIG. 1, there is required a structure allowing the extraction of the photosensitive drum from the apparatus for the purpose cleaning or replacement of said drum. For this reason the high-voltage cables leading to the corona dischargers are located generally at the rear side of the apparatus which is opposite to the direction of drum extraction, and the drive system for the copier is also located at said rear side. It therefore becomes necessary to provide sufficient space for the high-voltage cables for ensuring mechanical and electrical safety between the drive system and the high-voltage cables. Also there should be provided sufficient space for the discrete high-voltage connectors for various corona dischargers positioned around the photosensitive drum. Consequently the presence of such cables and connectors has been a serious obstacle to the compactization of the apparatus.

Also in a corona discharger, as the discharge current between the discharging wire and the casing of the discharger is larger than that between said wire and the photosensitive drum, it is desirable for the purpose of noise prevention that said casing is positioned close to the grounding terminal of the high-voltage power source. However the grounding is generally achieved through the body of the copier, and such arrangement increases the impedance of the high-voltage circuit and is not desirable for noise prevention.

SUMMARY OF THE INVENTION

The principal object of the present invention is to provide a high-voltage power source which is small, inexpensive, and free from the above-mentioned drawbacks and from undesirable noise.

Another object of the present invention is to provide a high-voltage power source wherein the casing or shield of the corona discharger is automatically and directly connected to the grounding terminal of the power source by connecting a plug of the discharger to a connector.

The above-mentioned objects of the present invention are achieved by a high-voltage power source including a transformer for converting a low voltage into a high voltage suitable for corona discharge, a casing enclosing said transformer, and plural connectors integrally mounted on said casing. The connectors are connected to the output terminals of said transformers without the use of high-voltage cables and adapted for directly receiving the plugs of respective corona discharger, wherein said connectors are provided in the vicinity thereof with grounding terminals for direct grounding connection of the casing or shield of the corona dischargers directly to the high-voltage power source.

The foregoing and other objects and advantages of the present invention will be further clarified by the following detailed description to be taken in conjunction with the attached drawings.

DESCRIPTION OF THE PREFERRED EMBODIMENT

Now the present invention will be explained in detail with respect to an embodiment thereof shown in the attached drawings.

Figure 1:
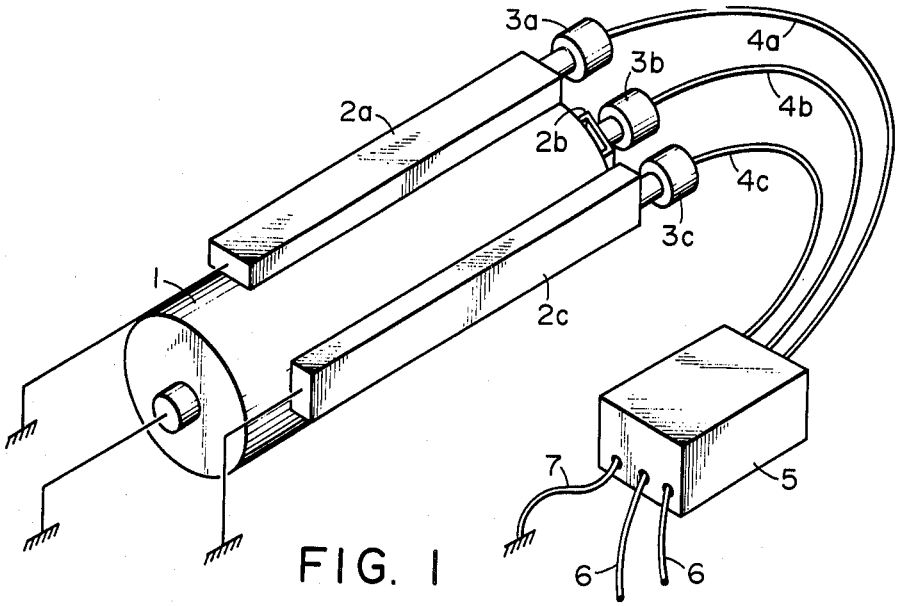
FIG. 1 is a schematic perspective view of a conventional electrophotograhic copier.
Figure 2:
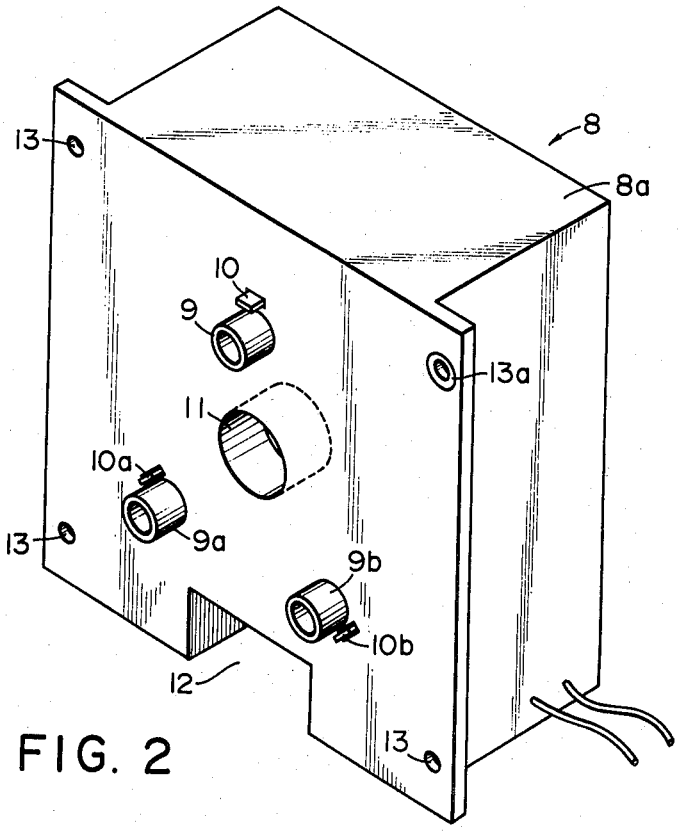
FIG. 2 is a perspective view of the high-voltage power source embodying the present invention.

As shown in the external view of FIG. 2, the high-voltage power source 8 of the present invention has a casing 8*a* which is provided with output connectors 9, 9*a* and 9*b* to be connected to the corona dischargers and grounding terminals 10, 10*a* and 10*b* and the casings of said dischargers. Inside the high-voltage power source there is provided a transformer (not shown) for converting a line supply voltage, for example AC 100 V or AC 200 V, into a high voltage suitable for corona discharge, for example in the range of ca. 3.5 to 8 KV, of which the secondary coil is connected at an end thereof to said connectors 9, 9*a* and 9*b* and at the other end thereof to said grounding terminal 10, 10*a* and 10*b*. Said casing 8*a* is further provided, in a position corresponding to the shaft of the photosensitive drum, with an opening 11 for providing a space for the projecting portion of said shaft, and with a recess 12 for accommodating driving gears of the drum drive system. In case the photosensitive drum is provided therein with a heater for warming the drum, the power supply contacts for said heater may be conveniently provided in said opening 11. For the purpose of mounting the power supply in the copier, the casing 8*a* is provided at the corner portions thereof with openings 13, among which the opening 13*a* functions as the grounding terminal of the power source, whereby the power source is automatically grounded upon mounting on a side plate of the copier, without separate ground wiring operation from the power source to the body of the copier.

Figure 3:
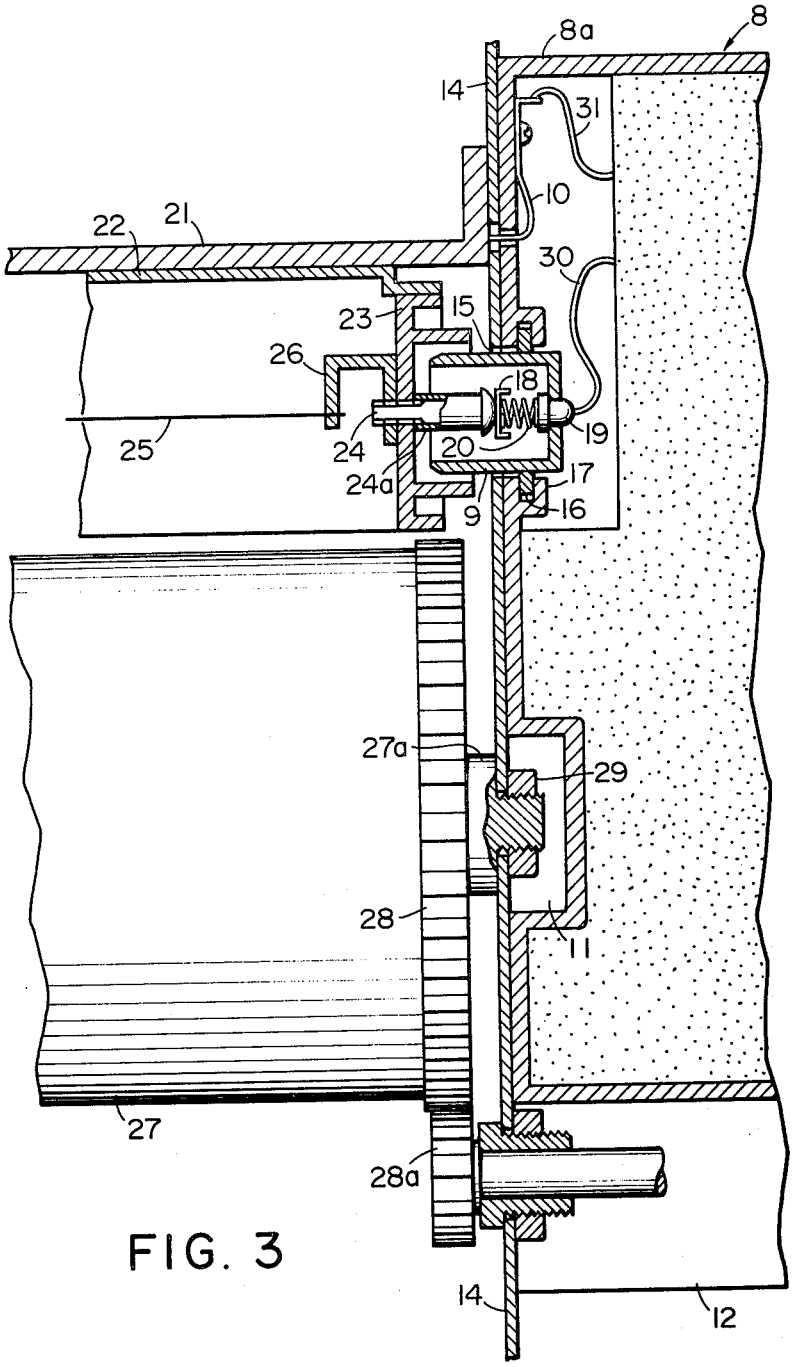
FIG. 3 is a cross-sectional view showing the direct mounting of the photosensitive drum and corona discharger on the high-voltage power source of the present invention.

FIG. 3 shows, in a cross-sectional view, the mounting of the high-voltage power source of the present invention together with the photosensitive drum and the corona discharger on the side plate of the copier. The power supply 8 may be provided with only one connector 9, but, since the copier or similar apparatus requires plural corona discharger - for charging, image transfer, charge elimination etc., it is more advantageous that plural connectors corresponding to the number of the corona dischargers are integrally mounted on the casing 8*a* as shown in FIG. 2. For this reason it is possible to dispense with the rather tedious operation of binding the high-voltage cables and to guide the same to avoid the drive system, and also to save the space for such cables. Furthermore, there can be eliminated the procedures of mounting high-voltage connectors on corona dischargers and the space for such high-voltage connectors. A particularly important advantage of the present invention is that the direct connection between the output terminals of the transformer to the connectors without high-voltage cables allows it to prevent noise generation and leakage current.

The mounting positions of said connectors have to be exactly defined with respect to the position of the drum. This requirement can be accommodated if the internal diameter of the connector is made somewhat larger than the external diameter of the plug of the corona discharger so that a complete connection of the plug can be achieved despite the slight positional aberration of the connector. Otherwise this requirement can be met by providing the side plate 14 of the copier with a connector receiving hole 15 in a position exactly defined with respect to the drum shaft, and by rendering the connector 9 movable with respect to the power source 8 in a radial direction perpendicular to the inserting direction of the plug, whereby the connector 9 is exactly positioned by said hole 15 at the mounting of the power source on said side plate. In order to realize such arrangement the connector 9 is rendered movable to a certain extent in the radial direction with respect to the casing 8*a* and is provided with a flange 16 on the outer periphery in order to prevent displacement in the axial direction, i.e. the inserting direction of the plug, and the casing 8*a* is provided with a support member 17 for engaging with said flange 16. In this manner the connectors, upon mounting of the power source on the copier, can be easily positioned with respect to the copier with limited play in the axial direction, whereby the mounting of plural corona dischargers on respective connectors is significantly facilitated. In the connector 9 there is provided a contact 18 to the connector linked with a high-voltage lead terminal 19 through a spring 20, which assures secure contact with a plug 24 of the corona discharger.

A grounding terminal 10 corresponding to the connector 9 is composed of a material performing a spring action and is maintained to protrude from the casing of the power source 8, whereby said terminal is brought into intimate contact with the metal casing 21 of the discharger mounted on the side plate 14 of the copier when the power source is mounted on said side plate 14, thus forming the shortest grounding connection between the discharger and the high-voltage power source.

The corona discharger is composed of a conductive shield 22 and insulating side plates 23, only one of which, at the side closer to the high-voltage power source, is shown in FIG. 3. The plug 24 of the discharger is screwed through a spacer 24*a* to a fixing member 26 of a discharge wire 25, which is provided between said fixing member 26 and another unrepresented side plate on the opposite side. The shield 22 of the discharger is mechanically and electrically connected to the aforementioned casing or guide 21. Naturally the shield 22 may be so structured as to come into direct contact with the grounding terminal.

The photosensitive drum 27 is rotatable about a drum shaft 27*a* which is mounted on the side plate 14 by means of a nut 29. The presence of the recess or opening 11 in a position corresponding to the mounting position of said shaft allows close contact of the power source 8 with the side plate 14.

The photosensitive drum 27 is provided with a fixed gear 28 which meshes with a drum drive gear 28*a* mounted on the body of the copier, wherein the drive shaft of the drum is accommodated in the recess 12 provided on the high-voltage power source 8.

In FIG. 3, 30 and 31 are secondary terminal wires of the high-voltage transformer housed in the high-voltage power source 8. The interior of the casing 8*a* is filled with an insulating material such as pitch in which the high-voltage transformer is embedded. The connector 9 can be composed of ordinary insulating materials such as vinylic resin. Also, the grounding wire 31 may be composed, for example, of a spring or other member to be connected directly to the casing or the shield of the corona discharger.

As already explained, the high-voltage power source shown in FIG. 2 is provided with plural connectors which are adapted to supply an AC voltage, for example, to a corona discharger for eliminating the remaining potential on the photosensitive drum, and to supply a DC voltage through a rectifier to a corona discharger for uniform charging of the photosensitive drum or for image transfer. Also they may be designed to supply an AC voltage superposed with a DC voltage or an asymmetrically distorted AC voltage. In this manner the high-voltage power source of the present invention can be utilized to supply plural corona dischargers with outputs of the same voltage and polarity or with outputs of different voltages, polarities or wave forms.

The high-voltage supply source of the present invention may be mounted on the bottom plate of the copier in case a transformer of an elevated capacity is required for feeding an increased number of corona dischargers in the electrophotographic apparatus. However a compact and light high-voltage power source utilizing an inverter transformer has now become easily available, and such power source is sufficiently mountable directly on the side plate at the rear side of the photosensitive drum.

The use of a high-frequency alternative current in the voltage elevation provides the following advantages. Whereas the conventionally used high-voltage power transformer utilizing commercial frequency of 50 Hz or 60 Hz is relatively large (ca. 1300 $cm^3$) and can hardly be installed close to the corona dischargers in the electrophotographic apparatus due to the spatial limitation, the dimension of the transformer can be easily reduced to $\frac{1}{2}$ to $\frac{1}{3}$ at a frequency of 500 Hz to 1 KHz, or to 1/5 or even smaller at a frequency of ca. 10 KHz, since at a higher frequency the core of the transformer can be significantly compactized and the number of turns of the coils can also be greatly reduced.

Furthermore, the use of a higher frequency in the AC corona discharger allows prevention of uneven charge elimination of the photosensitive member. This uneven charge elimination, appearing as so-called "cycle marks" or stripe patterns of high-potential portions and low-potential portions on the photosensitive member corresponding to the cycles of alternating current when the photosensitive member is brought into facing relationship to the AC corona discharger, can be substantially eliminated by the increase in the frequency.

On the other hand, the use of a higher frequency results, when a high-voltage cable is used between the transformer and the corona discharger, in a significant current loss due to the electrostatic capacity of the cable. According to the present invention, however, the direct connection between the high-voltage power source and the corona discharger without high-voltage cable allows the use of a high frequency AC current without resulting in such loss.

The frequency to be employed should preferably be in the range of 500 Hz to 20 KHz, since a frequency in the range of 100–500 Hz may result in uneven charge elimination due to the vibration of the corona wire, while a frequency higher than 20 KHz does not allow further compactization of the transformer because of insulating requirements.

As detailedly explained in the foregoing, the present invention featuring plural connectors mounted on the casing of the high-voltage power source, thereby allowing the shortest direct connection to the corona dischargers without going through high-voltage cables, is advantageous in assuring stable functions of the logic circuits, composed for example of integrated circuits or large-scale integrated circuits, saving space and reducing manufacturing costs, thereby allowing compact and inexpensive electrophotographic apparatus.

Also, said connectors, being fixed in the inserting direction of the plugs of the corona dischargers but rendered displaceable in the perpendicular direction, are easily positioned with respect to the body of the electrophotographic apparatus at the mounting of the high-voltage power source on said apparatus.

It will also be understood that the present invention is applicable not only to the photosensitive drum as shown in the foregoing embodiment but also to an insulating drum or to photosensitive members of other shapes, for example, a belt-shaped photosensitive member.

What we claim is:

1. A high-voltage power source for supplying a high voltage to a corona discharger which applies corona to an image-carrying member of an image forming apparatus, comprising:

a transformer for converting a lower voltage into a high voltage suitable for corona discharge;

a casing encircling said transformer; and connector means integrally mounted on said casing, said connector means being connected to the output side of said transformer, and adapted to be directly connected to the plugs of said corona discharger for supplying a high voltage to the corona wires thereof.

2. A high-voltage power source according to claim 1, wherein said casing is mounted on a side plate on which an image-carrying member is mounted.

3. A high-voltage power source according to claim 2, wherein the entire high-voltage power source is grounded through a mounting hole of said casing to said side plate.

4. A high-voltage power source according to claim 2, wherein said transformer is an inverter transformer.

5. A high-voltage power source according to claim 2, wherein said image-carrying member comprises a drum, and wherein said casing is provided with a recess or an opening for receiving the shaft of said image-carrying drum.

6. A high-voltage power source according to claim 2, wherein said image-carrying member comprises a drum, and wherein said casing being provided with a recess for receiving the drum drive system.

7. A high-voltage power source according to claim 1 or 2, wherein said connector means are being mounted in such a manner as to be fixed in the inserting direction of said plug but to be displaceable in the direction perpendicular thereto.

8. A high-voltage power source according to claim 1 or 2, wherein the internal diameter of said connector means is being larger than the external diameter of said plugs of the corona dischargers.

9. A high-voltage power source according to claim 1 or 2, wherein said connector means is being adapted to supply an AC voltage, a DC voltage, an AC voltage superposed with a DC voltage or an asymmetrically distorted AC voltage.

10. A high-voltage power source for supplying a high voltage to corona dischargers, comprising:

an inverter transformer adapted to convert a low voltage into a high voltage suitable for corona discharge;

a casing encircling said transformer and mounted on a side plate on which an image-carrying member is mounted, said casing further comprising a recess for receiving the drive system of said image-carrying member, and further functioning to electrically ground the entire high-voltage power source through a mounting hole thereof; and plural connectors integrally mounted on said casing, having internal diameters larger than the external diameter of the plugs of the corona dischargers, connected to the output side of said transformer without high-voltage cables and adapted to be directly connected with said plugs of the corona dischargers for supplying a high voltage to the corona wires thereof.

11. A high-voltage power source for supplying a high voltage to corona dischargers, comprising:

a transformer adapted to convert a low voltage to a high voltage suitable for corona discharge;

a casing encircling said transformer;

a connector integrally mounted on said casing, connected to the output side of said transformer without high-voltage cables and adapted to be directly connected to the plugs of said corona dischargers for supplying a high voltage to the corona wires thereof; and a grounding terminal provided in the vicinity of said connectors and adapted to be directly contacted with the casings or shields of the corona dischargers for grounding the same.

12. A high-voltage power source according to claim 11, further comprising a plurality of said connectors and grounding terminals.

13. A high-voltage power source according to claim 11 or 12, wherein said casing is mounted on a side plate of an image forming apparatus on which an image-carrying member is mounted.

14. A high-voltage power source according to claim 13, wherein the entire high-voltage power source is grounded through a mounting hole of said casing.

15. A high-voltage power source according to claim 13, wherein said transformer is an inverter transformer.

16. A high-voltage power source according to the claim 13, wherein said image-carrying member comprises a drum, and wherein said casing including an opening for receiving the shaft of said image-carrying drum.

17. A high-voltage power source according to the claim 13, wherein said image-carrying member comprises a drum, and wherein said casing comprising a recess for receiving the drum drive system.

18. A high-voltage power source according to the claim 11 or 12, wherein said connector means are being mounted in such a manner as to be fixed in the inserting direction of said plugs but rendered displaceable in the perpendicular direction thereto.

19. A high-voltage power source according to claim 11 or 12, wherein said connectors have an internal diameter larger than the external diameter of the plugs of corona dischargers.

20. A high-voltage power source according to claim 11 or 12, wherein said grounding terminals are composed of spring members and adapted to automatically ground the casings or shields of corona dischargers when they are inserted into said connectors.

21. A high-voltage power source according to claim 11 or 12, wherein each of said connectors is adapted to supply an AC voltage, a DC voltage, an AC voltage superposed with a DC voltage or an asymmetrically distorted AC voltage.

22. A high-voltage power source according to claim 1, 2, 10, 11 or 12, wherein an AC current of a frequency within a range of 500 Hz to 20 KHz is supplied to said transformer.

23. A high-voltage power source according to claim 5, further comprising contacts for supplying electric current to a heater provided in the drum for warming the photosensitive member, said contacts being provided in the opening for receiving said drum shaft.

24. A high voltage power source according to claim 1 wherein said connector includes plural connector elements.

* * * * *